United States Patent [19]

Izzi

[11] 4,406,480

[45] Sep. 27, 1983

[54] WATER CLOSET COUPLING

[75] Inventor: Lewis B. Izzi, Shelby, N.C.

[73] Assignee: Plastic Oddities, Inc., Shelby, N.C.

[21] Appl. No.: 262,741

[22] Filed: May 11, 1981

[51] Int. Cl.[3] ..... F16L 47/02

[52] U.S. Cl. ..... 285/12; 4/252 R; 285/58; 285/DIG. 16

[58] Field of Search ..... 285/56, 57, 58, 59, 285/60, 12, DIG. 16; 4/252 R

[56] References Cited

U.S. PATENT DOCUMENTS

| | | | |
|---|---|---|---|
| 1,042,087 | 10/1912 | Clifford | 285/60 |
| 2,152,719 | 4/1939 | Williams | 285/58 X |
| 2,596,182 | 5/1952 | Sosaya | 285/60 X |
| 2,679,155 | 5/1954 | Zinn | 285/56 X |
| 3,101,960 | 8/1963 | Danescu | 285/58 |
| 3,319,268 | 5/1967 | Blumenkranz | 285/58 X |
| 3,540,064 | 11/1970 | Studer | 4/252 R |
| 3,775,780 | 12/1973 | McEwen | 285/58 X |
| 3,967,326 | 7/1976 | Tammen | 285/58 X |
| 3,967,836 | 7/1976 | Izzi, Sr. | 285/58 X |
| 4,233,697 | 11/1980 | Cornwall | 285/58 X |

*Primary Examiner*—Thomas F. Callaghan
*Attorney, Agent, or Firm*—Laurence R. Brown

[57] ABSTRACT

An improved plumbing fitting for coupling a water closet to a building surface and to the drain waste pipe which eliminates the need for cutting off the waste pipe beneath the floor level.

1 Claim, 4 Drawing Figures

WATER CLOSET COUPLING

This invention relates generally to plumbing fittings and more particularly to an improved coupling for connecting a water closet to a drain waste pipe.

Couplings for such purpose are well known in the art and insofar as is known, all of them are characterized by the same design disadvantage of a beveled inner rim which necessitates the cutting off of the drain waste pipe below the floor or building surface level to make a proper connection.

This disadvantage requires additional time by the plumber and the use of special and expensive cutting instruments whether the drain pipe is mounted on the outer or inner sides of the connector collar and also requires specific annular surface contact dimensions between the drain pipe and the collar.

Accordingly, the main object of the present invention is to provide an improved coupling for connecting a water closet to a drain waste pipe which will obviate the above and other disadvantages of known couplings.

An important object of the present invention is to provide an improved coupling of the type described which enables the waste drain pipe to be cut off flush with the floor or wall surface to thus save the plumber's time and obviate his need to stock expensive additional cutting tools.

Another important object of the present invention is to provide an improved coupling for connecting water closets with drain waste pipes which lies flat on the building wall or floor surface and affords ready alignment of the water closet in its proper position with respect to a wall, etc.

Other objects and advantages of the present invention will become apparent during the course of the following description.

In the drawings, there is shown one embodiment of the invention. In this showing:

Figure 3:
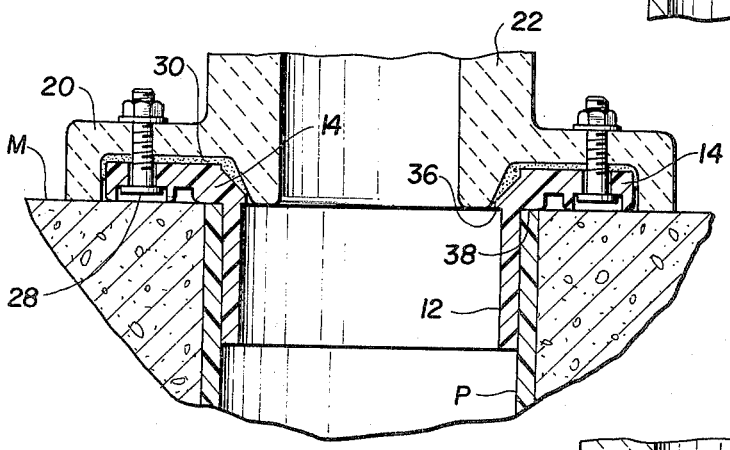
Figure 4:
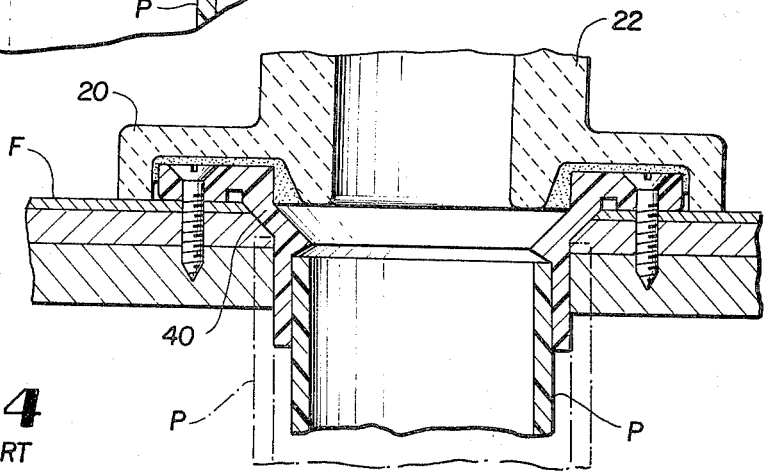
FIG. 4 PRIOR ART

FIG. 3 is a similar view of a typical installation of the coupling in concrete slab construction showing the means of attaching the coupling to the water closet, anchors, etc. being utilized to receive mounting screws in such masonry construction; and FIG. 4 is a similar view illustrating why the waste drain pipe must be cut off below the floor or wall level when prior art type couplings are employed.

Referring now to the drawings, numeral 10 designates the improved coupling comprising the present invention as a whole which comprises a depending or projecting collar 12 and an integral radially extending peripheral flange 14 extending outwardly from an end periphery of the collar 12. The coupling 10 is preferably formed of plastic so as to be solvent welded to plastic drain waste pipes P but can be of other materials with other connection means.

The flange 14 is provided with a plurality of circumferentially spaced, counter-sunk screw holes 16 for flush fitting and connecting it to wooden floors or walls or to anchors in masonry installations, and a plurality of arcuate slots 18 for connecting it to the base 20 of a water closet 22.

Figure 1:
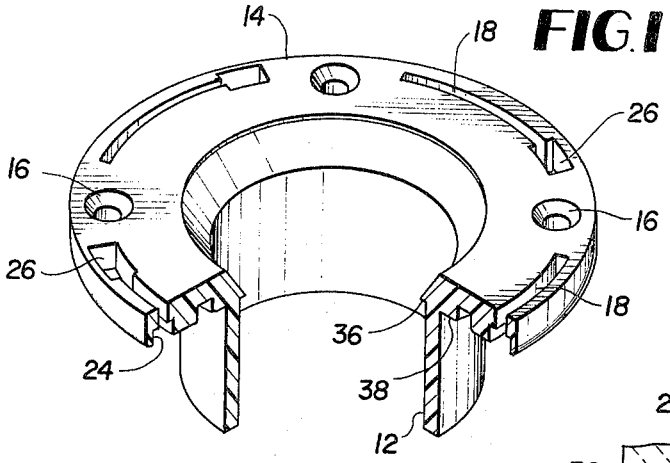
FIG. 1 is a cut-away perspective view of the coupling comprising the present invention.

The slots 18 are partially recessed from their bottoms as at 24 and are provided with keyhole slot openings 26. These allow the insertion of the bolt heads 28 (FIGS. 1 and 3) from the top of the flange 14 and arcuate movement to effect alignment of the water closet 22 in the proper position. A seal is formed between the flange 14 and the base 20 of the water closet 22 by means of a wax gasket 30, etc.

The flange 14 is tapered on its upper side only as at 32 to form a cylindrical opening to allow the outlet 34 of the water closet 22 to empty into the collar 12 and to form a shoulder 36 which forms a positive stop for waste drain pipes P. A second flat annular shoulder 38 is formed on and in alignment with the bottom surface of the flange 14 adjacent the top of the collar 12 as a stop for larger waste drain pipes at the floor surface level.

Figure 2:
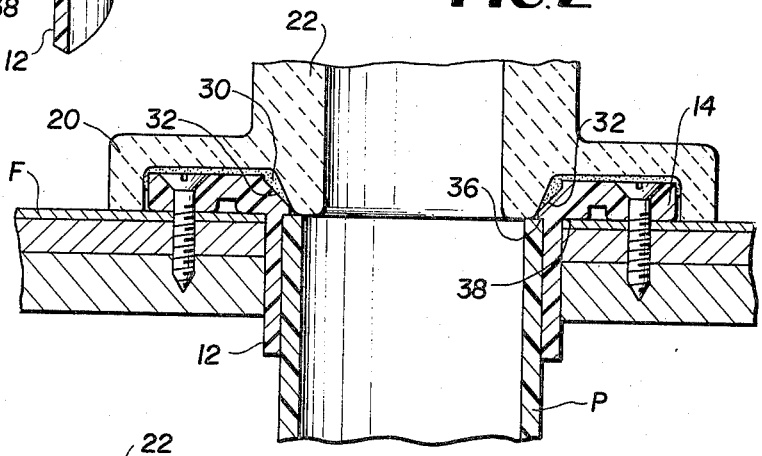
FIG. 2 is a central vertical sectional view of a typical installation of the coupling in wood floor construction showing the means of attaching the coupling to the floor and the drain pipe cut off flush with the surface of the finished floor level.

Thus when used with 3 inch waste drain pipes P (FIG. 2) or with 4 inch pipes (FIG. 3), the flange 14 lies flat on the floor surface F or on the masonry surface M which permits the pipe to be cut off flush with either.

On the contrary, the prior art couplings (FIG. 4) all have tapered portions 40 of one type or another which necessitates the cutting off of the waste drain pipes P below the surfaces F or M due, as shown, to the taper on both sides of the portion 40.

It will now be seen that the invention is a very important step forward the the art in that it saves the plumber important time in installation and money in his tool inventory.

It is to be understood that the form of my invention herewith shown and described is to be taken as a preferred example of the same and that various changes in the shape, size and arrangement of parts may be resorted to without departure from the spirit of the invention or the scope of the subjoined claims.

What is claimed is:

1. The combination with a building surface having a waste drain opening and a plastic waste drain pipe of smaller diameter mounted therein and cut off flush with the surface; of a one piece plastic solvent weldable couping for connecting a water closet having a drain opening to the waste drain pipe; said coupling comprising a threadless cylindrical collar of a diameter for sealing engagement with the inner or outer circumference of said waste drain pipe so as to be welded thereto; a peripheral, outwardly extending flange formed integrally with an end of said collar and lying flat against said building surface and the end of said waste drain pipe when disposed outside the collar, and an inwardly extending shoulder formed integrally with the collar for abutting the end of a drain pipe when disposed inside the collar; a seal between said flange and the sides of said water closet drain opening; elongated arcuate openings in said flange for receiving fasteners for connecting it to said water closet; and separate apertures in said flange for connecting it with fasteners to said building surface.

* * * * *

Dedication 4,406,480.—*Lewis B. Izzi,* Shelby, N.C. WATER CLOSET COUPLING. Patent dated Sept. 27, 1983. Dedication filed Feb. 11, 1985, by the assignee, *Plastic Oddities, Inc.*

Hereby dedicates the remaining term of said patent to the People of the United States of America.

[*Official Gazette April 9, 1985.*]